US012710220B2

(12) United States Patent
Lee et al.

(10) Patent No.: US 12,710,220 B2
(45) Date of Patent: Aug. 18, 2026

(54) REFRIGERATOR

(71) Applicant: LG ELECTRONICS INC., Seoul (KR)

(72) Inventors: Sanggyun Lee, Seoul (KR); Younseok Lee, Seoul (KR); Yongwon Dong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 132 days.

(21) Appl. No.: 18/722,717

(22) PCT Filed: Dec. 9, 2022

(86) PCT No.: PCT/KR2022/020049
§ 371 (c)(1),
(2) Date: Jun. 21, 2024

(87) PCT Pub. No.: WO2023/121084
PCT Pub. Date: Jun. 29, 2023

(65) Prior Publication Data

US 2025/0137713 A1 May 1, 2025

(30) Foreign Application Priority Data

Dec. 21, 2021 (KR) ..... 10-2021-0183627

(51) Int. Cl.
*F25D 23/02* (2006.01)
*F25D 23/04* (2006.01)
*F25D 23/08* (2006.01)

(52) U.S. Cl.
CPC ..... *F25D 23/028* (2013.01); *F25D 23/04* (2013.01); *F25D 23/087* (2013.01); *F25D 2331/806* (2013.01)

(58) Field of Classification Search
CPC ..... F25D 23/028; F25D 23/04; F25D 23/087; F25D 2331/806
See application file for complete search history.

(56) References Cited

U.S. PATENT DOCUMENTS 11,150,004 B1 * 10/2021 Kumar ..... F25D 23/028
2009/0178429 A1 * 7/2009 Lee ..... F25D 23/126 62/344

(Continued)

FOREIGN PATENT DOCUMENTS

CN 110130758 8/2019
KR 10-0596569 7/2006

(Continued)

OTHER PUBLICATIONS

International Search Report dated Mar. 15, 2023 issued in Application No. PCT/KR2022/020049.

*Primary Examiner* — Daniel J Rohrhoff
(74) *Attorney, Agent, or Firm* — KED & ASSOCIATES, LLP

(57) ABSTRACT

The refrigerator of the present embodiment comprises: a cabinet including a storage space; a door configured to open or close the storage space and including a dispenser; and a hinge device configured to rotatably connect the door to the cabinet, wherein the door comprises: a door frame including a door opening disposed at a position spaced apart from the center of rotation by the hinge device; a door liner coupled to the door frame and including an ice-making compartment wall forming an ice-making compartment; and an ice maker accommodated in the ice making compartment to produce ice, and a horizontal distance from a front surface of the door to the center of the door opening is greater than the distance from the front surface of the door to the center of rotation, and the horizontal distance from the front surface of the door to the center of the door opening is smaller than the distance (Continued)

from the front surface of the door to a front wall facing the front surface of the door among walls forming the ice-making compartment.

16 Claims, 13 Drawing Sheets

(56) References Cited

U.S. PATENT DOCUMENTS

| | | | | |
|---|---|---|---|---|
| 2011/0146323 | A1* | 6/2011 | Choi | F25D 23/04 62/340 |
| 2016/0370071 | A1* | 12/2016 | Koo | F25C 5/22 |
| 2017/0343275 | A1* | 11/2017 | Kim | B67D 1/0895 |
| 2018/0335246 | A1 | 11/2018 | Jeong et al. | |
| 2019/0024962 | A1* | 1/2019 | Lee | F25D 25/00 |
| 2021/0148623 | A1* | 5/2021 | Jeong | F25C 1/24 |
| 2021/0148627 | A1* | 5/2021 | Jeong | F25D 17/08 |
| 2025/0044017 | A1* | 2/2025 | Lee | F25D 23/068 |

FOREIGN PATENT DOCUMENTS

| | | |
|---|---|---|
| KR | 10-2010-0054353 | 5/2010 |
| KR | 10-2012-0026853 | 3/2012 |
| KR | 10-2018-0057717 | 5/2018 |

* cited by examiner

REFRIGERATOR

CROSS-REFERENCE TO RELATED PATENT APPLICATIONS

This application is a U.S. National Stage Application under 35 U.S.C. § 371 of PCT Application No. PCT/KR2022/020049, filed Dec. 9, 2022, which claims priority to Korean Patent Application No. 10-2021-0183627, filed Dec. 21, 2021, whose entire disclosures are hereby incorporated by reference.

TECHNICAL FIELD

The present specification relates to a refrigerator.

BACKGROUND ART

In general, a refrigerator is a home appliance for storing food at a low temperature in a storage space that is covered by a refrigerator door. The refrigerator is configured to keep stored food in an optimal state by cooling the inside of the storage space using cold air generated through heat exchange with a refrigerant circulating in a refrigeration cycle.

The refrigerator may be placed independently in a kitchen or a living room or may be accommodated in a kitchen cabinet.

The refrigerator is gradually becoming larger and more multi-functional in accordance with the change in dietary life and the trend of higher quality products. Refrigerators including various structures and convenience devices that take user convenience into consideration are being released.

As the prior art document, Korean Patent Registration No. 10-0596569 discloses a refrigerator.

The refrigerator of the prior art document includes a main body that forms a cooling compartment, a door that opens or closes the cooling compartment, and a water dispenser provided in the door.

The refrigerator includes a hinge portion connecting the door to the main body, a water supply pipe that supplies water from a water supply source to the water dispenser via the main body, the hinge portion, and the door, a hinge shaft body coupled to the hinge portion and made of a tubular body through which the water supply pipe passes, and a hinge shaft provided with a guide portion having an approximately elliptical cross-section such that the water supply pipe is introduced into the hinge shaft body at a gentle slope. The hinge shaft is provided at the hinge portion so as to be rotatable about the axis of the hinge shaft.

In the prior art document, since the water supply pipe and electric cables pass through the hinge portion and extend into the door, the diameter of the hinge portion has to be large. When the diameter of the hinge portion increases, there is a disadvantage in that the total thickness of the door increases.

On the other hand, in order to reduce the thickness of the door, the diameter of the hinge has to be reduced. However, there is a disadvantage in that the water pipe or electric cables cannot pass through the hinge portion.

DISCLOSURE OF INVENTION

Technical Problem

The present embodiment provides a refrigerator that allows at least one of a wire or a water pipe to be inserted into a door while reducing a thickness of the door.

Alternatively or additionally, there is provided a refrigerator that may maintain insulation performance of a door while reducing the thickness of the door.

Alternatively or additionally, there is provided a refrigerator that prevents water in a water pipe inside a door guide from being frozen by cold air in a cold air duct.

Technical Solution

A refrigerator according to one aspect may include a cabinet including a storage space; a door configured to open or close the storage space, the door including a dispenser; and a hinge device configured to rotatably connect the door to the cabinet.

The door may include a door frame including a door opening disposed at a position spaced apart from a rotation center by the hinge device. At least one of a water pipe or a wire may pass through the door opening.

The door may further include a door liner coupled to the door frame and having an ice-making compartment wall forming an ice-making compartment.

The door may further include an ice maker accommodated in the ice-making compartment to generate ice.

A horizontal distance from a front surface of the door to a center of the door opening may be greater than a distance from the front surface of the door to the rotation center.

The horizontal distance from the front surface of the door to the center of the door opening may be less than a distance from a front surface of the door to a front wall facing the front surface of the door of the ice-making compartment wall.

The door may further include a gasket coupling portion to which a gasket in contact with the cabinet is coupled. The gasket coupling portion may include an extension portion that is in contact with the door frame.

A horizontal distance from the front surface of the door to the front wall may be greater than ½ of a distance from the front surface of the door to the extension portion.

A horizontal distance from the front surface of the door to the front wall may be greater than ½ of a thickness of the door frame.

A horizontal distance between the front surface of the door and a rotation center of the ice maker may be greater than a horizontal distance between the front surface of the door and the gasket or a distance between the front surface of the door and the gasket coupling portion.

A vertical line passing through a rotation center of the ice maker may be located at a rear side spaced apart from the gasket.

The bottom of the ice-making compartment wall may include an ice discharge hole. A horizontal distance from the front surface of the door to the ice discharge hole may be greater than a horizontal distance from the front surface of the door to the extension portion.

An ice chute configured to guide ice having passed through the ice discharge hole to the dispenser may be provided below the bottom of the ice-making compartment wall. The ice chute may include an ice opening for ice discharge.

A horizontal distance from the front surface of the door to the ice opening may be greater than a horizontal distance from the front surface of the door to the extension portion.

The door may further include: a first duct configured to guide cold air to the ice-making compartment, and a second duct configured to guide the cold air discharged from the ice-making compartment to the outside of the door.

The door liner may include a dike, a portion of which forms the ice-making compartment, the dike being disposed in a form that protrudes from the door frame.

A protruding length of the dike may be greater than a passage width of at least one of the first duct or the second duct.

The protruding length of the dike may be greater than a thickness of the door frame.

The passage width of at least one of the first duct or the second duct may be greater than a thickness of the door frame.

The first duct may include a first portion communicating with the ice-making compartment. The first duct may further include a second portion extending obliquely in a direction closer to the front surface of the door at a lower side of the first portion. The first duct may further include a third portion extending downward from the second portion.

An entire area of the first portion may be located inside the dike.

A horizontal distance from the front surface of the door to the first portion may be greater than a horizontal distance from the front surface of the door to the extension portion.

The door may further include a guide aligned with the door opening at an inside of the door to accommodate at least one of the water pipe or the wire therein.

The guide may include: a first part aligned with the door opening; and a second part extending to be inclined toward one side frame of the door frame. The guide may further include a third part extending into a space between the one side frame and the dispenser at the second part.

The one side frame may be a side frame that is close to the rotation center among two side frames of the door frame.

A horizontal distance from the front surface of the door to the front wall may be greater than a distance from the front surface of the door to a center of the third part.

The door may further include an ice-making compartment door configured to open or close the ice-making compartment.

The ice-making compartment door may include two side surfaces and a connection surface connecting the two side surfaces, and the connection surface may include a straight portion connecting the two side surfaces in a straight line.

Advantageous Effects

According to the present embodiment, since a water pipe may pass through a door opening located at a position spaced apart from a hinge center of a door, there is an advantage in that the water pipe may be inserted into the door while reducing the thickness of the door.

According to the present embodiment, water in a water pipe inside a door guide may be prevented from being frozen by cold air in a cold air duct.

According to the present embodiment, there is an advantage in that it is possible to maintain insulation performance of a door while reducing the thickness of the door.

BEST MODE FOR CARRYING OUT THE INVENTION

Figure 1:
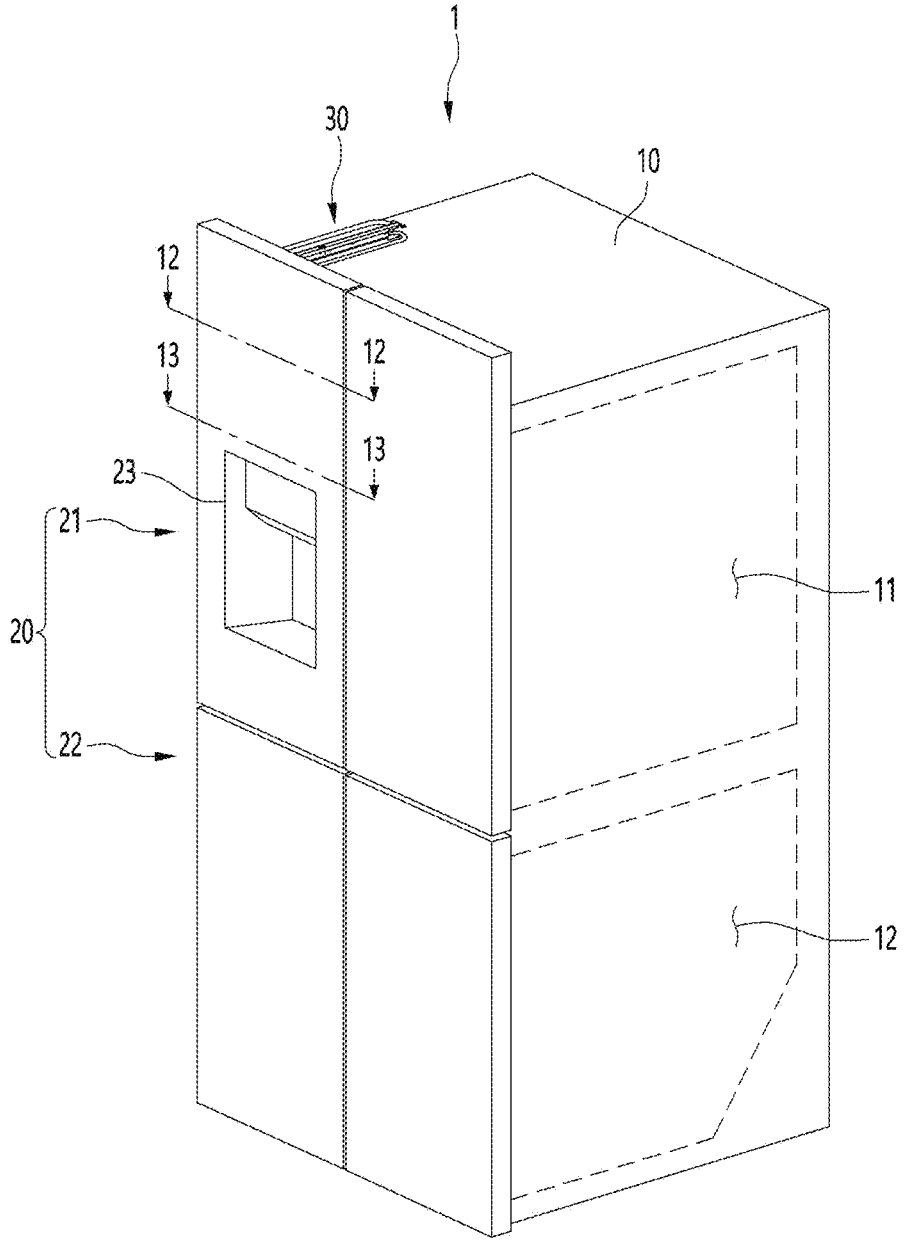
FIG. 1 is a perspective view of a refrigerator according to the present embodiment.

Hereinafter, some embodiments of the present invention will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. The terms are merely used to distinguish the corresponding component from other components, and do not delimit an essence, an order or a sequence of the corresponding component. It should be understood that when one component is "connected", "coupled" or "joined" to another component, the former may be directly connected or jointed to the latter or may be "connected", "coupled" or "joined" to the latter with a third component interposed therebetween.

Figure 2:
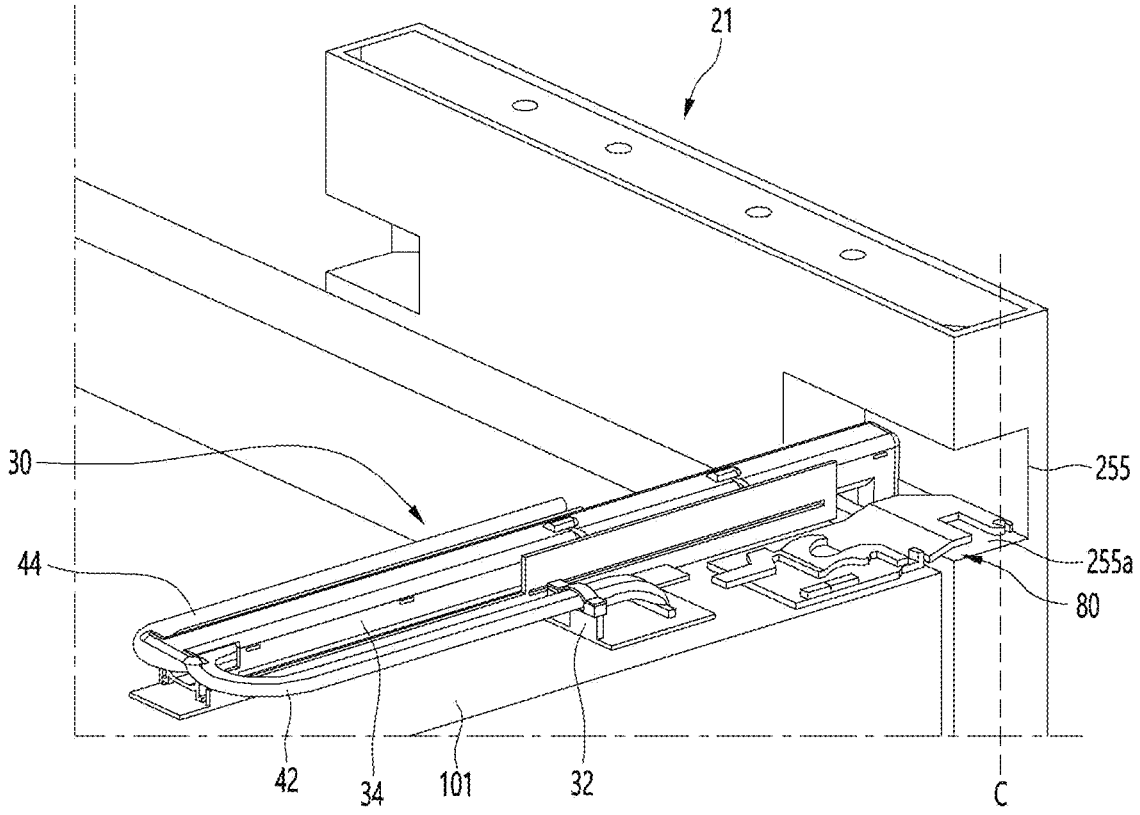
FIG. 2 is a perspective view showing a state in which a guide unit is connected to a cabinet and a door.
Figure 3:
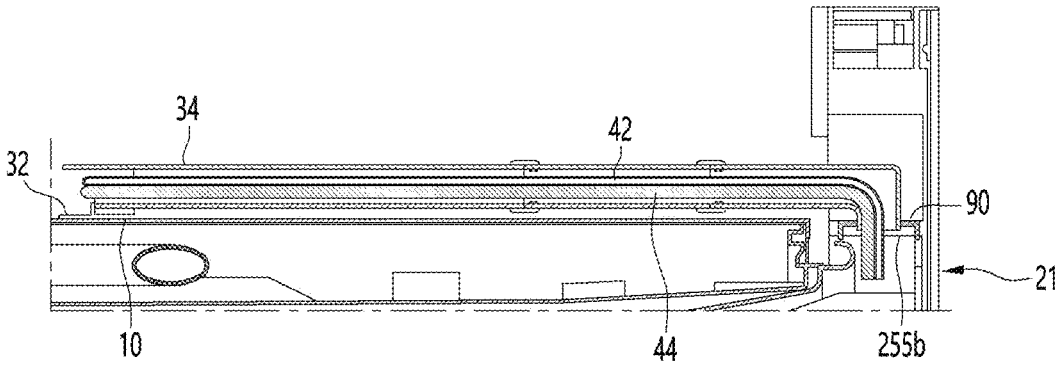
FIG. 3 is a cross-sectional view of a guide unit.
Figure 4:
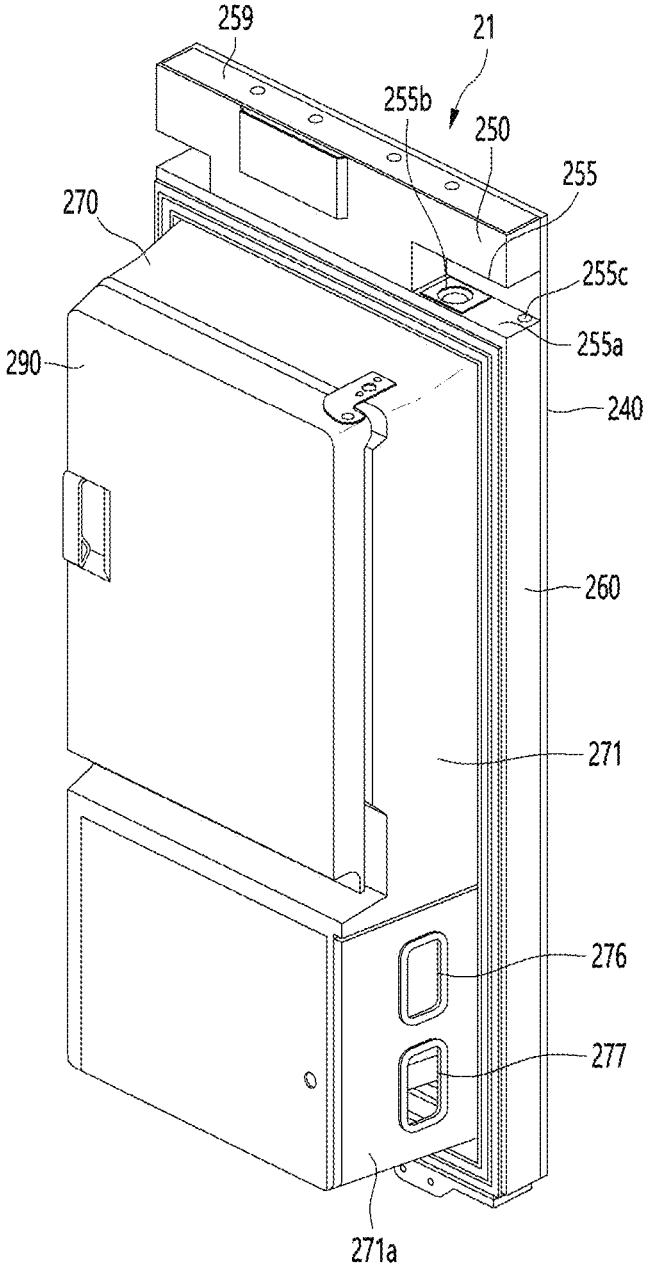
FIG. 4 is a perspective view of a first door of the present embodiment.

FIG. 1 is a perspective view of a refrigerator according to the present embodiment, FIG. 2 is a perspective view showing a state in which a guide unit is connected to a cabinet and a door, FIG. 3 is a cross-sectional view of a guide unit, and FIG. 4 is a perspective view of a first door of the present embodiment.

Referring to FIGS. 1 to 4, a refrigerator 1 according to the present embodiment may be independently installed in a kitchen or may be installed in an indoor furniture cabinet. When the refrigerator 1 is installed in an indoor furniture cabinet, the refrigerator 1 may be installed alone or may be disposed together with other refrigerators side-by-side.

The refrigerator 1 may include a cabinet 10 including a storage space, and a refrigerator door 20 that opens or closes the storage space.

The storage space is not limited, but may be divided into a first space 11 on an upper side and a second space 12 on a lower side. The refrigerator door 20 may include a first door 21 that opens or closes the first space 11 and a second door 22 that opens or closes the second space 12.

The first space 11 may be a refrigerating compartment and the second space 12 may be a freezing compartment, or vice versa. Alternatively, the storage space may include a first space and a second space divided into left and right sides. Alternatively, the storage space may be a single space, and a single refrigerator door may open or close the storage space.

At least one of the first door 21 or the second door 22 may be a rotary type door. Alternatively, the single refrigerator door 20 may be a rotary type door.

In the present embodiment, a case where two first doors 21 are disposed left and right is described as an example.

The first door 21 may be rotatably connected to the cabinet 10 by a hinge device 80. The hinge device 80 may include a hinge pin that provides a rotation center C of the first door 21.

At least one of the two first doors 21 may include a dispenser 23. The dispenser 23 may discharge water and/or ice. FIG. 1 shows an example in which the dispenser is provided in the first door 21 of the left side.

Although not shown, the first door 21 may be provided with a component that operates to discharge water and/or ice. The component may be one element of the dispenser 23. The component may be electrically connected to a wire 44. Alternatively, separately from the component, the first door 21 may include a display unit and/or an input unit, and the display unit and/or the input unit may be electrically connected to the wire 44.

For example, the wire 44 may be connected to a controller provided in the cabinet 10, may be inserted into the first door 21, and may be directly or indirectly connected to the component (when connected to a separate wire provided in the first door).

In order for the dispenser 23 to discharge water, the dispenser 23 may be connected to a water pipe 42. Since the dispenser 23 may also discharge liquids other than water, the water pipe 42 may be referred to as a liquid pipe.

The water pipe 42 may be withdrawn from the inside to the outside of the cabinet 10 and then inserted into the first door 21 through the first door 21.

In the present specification, it is noted that the expression "the wire 44 and/or the water pipe 42 are/is introduced into the first door 21 or the cabinet 10" means that the wire 44 and/or the water pipe 42 are/is withdrawn from the first door 21 or the cabinet 10.

The water pipe 42 may be inserted into the first door 21 and directly or indirectly connected to the dispenser 23 (when connected to a separate additional water pipe provided in the first door).

In the present embodiment, at least one of the water pipe 42 or the wire 44 may be inserted into the first door 21.

FIG. 2 shows an example in which the water pipe 42 and the wire 44 are inserted into the first door 21.

When installing the refrigerator 1 in a furniture cabinet of a kitchen, the refrigerator door 20 may generally protrude in front of the furniture cabinet, although the refrigerator door 200 may vary depending on the size of the furniture cabinet. In order to prevent the refrigerator door 20 from protruding in front of the furniture cabinet, it may be considered to reduce the thickness of the refrigerator door 20.

In the case of the general refrigerator 1, the refrigerator door 20 is thick. Accordingly, the diameter of the hinge pin of the hinge device 80 may be increased. In this case, the water pipe 42 and the wire 44 may pass through the hinge pin.

However, when reducing the thickness of the refrigerator door 20, the diameter of the hinge pin has to be reduced. When the diameter of the hinge pin is reduced, the water pipe 42 and the wire 44 cannot pass through the hinge pin.

Accordingly, in the present embodiment, the water pipe 42 and the wire 44 may pass through the refrigerator door 20 at a position spaced apart from the hinge device and may be inserted into the refrigerator door 20.

In the case of the present embodiment, the water pipe 42 and the wire 44 may pass through the first door 21 on one side of the hinge device 80.

The refrigerator of the present embodiment may further include a guide unit 30 for guiding the water pipe 42 and/or the wire 44. The guide unit 30 may be omitted.

The guide unit 30 may protect the water pipe 42 and/or the wire 44 and may minimize exposure of the water pipe 42 and/or the wire 44 to the outside during the process of opening the first door 21.

The guide unit 30 may include a guide housing 34 that accommodates the water pipe 42 and/or the wire 44.

The guide unit 30 may further include a cabinet guide 32 that is fixed to an upper wall 101 of the cabinet 10 to guide the movement of the guide housing 34.

The cabinet guide 32 may be provided at a position adjacent to the hinge device 80 in the cabinet 10.

The water pipe 42 may be withdrawn from the cabinet 10 directly behind the hinge device 80 and accommodated in the guide housing 34.

The water pipe 42 that is withdrawn from the cabinet 10 may extend rearward (in a direction away from the hinge device 80) and may be then inserted into the guide housing 34 from the rear side of the guide housing 34, but the present disclosure is not limited thereto.

The wire 44 may be located on the opposite side of the water pipe 42 with respect to the guide housing 34 and may be inserted into the guide housing 34 from the rear side of the guide housing 34, but the present disclosure is limited thereto.

When the first door 21 is in a closed state, the guide housing 34 may extend in a straight-line shape. Referring to FIG. 2, the guide housing 34 may extend in a straight-line shape in a front-and-back direction.

Accordingly, the water pipe 42 and the wire 44 may also be guided toward the first door 21 in a straight-line shape within the guide housing 34.

The top surface of the first door 21 may be located higher than the upper wall 101 of the cabinet 10. The first door 21 may include a recessed portion 255 such that the guide housing 34, which is movable along the cabinet guide 32 installed on the upper wall of the cabinet 10, is connected to the first door 21.

The recessed portion 255 may be formed as the rear surface of the first door 21 is recessed forward. The recessed portion 255 may be disposed at a position spaced downward from the top surface of the first door 21.

Substantially, a bottom **255*a* of the recessed portion 255 may be located at a height equal to or substantially similar to a height of the top surface of the cabinet 10**.

As another example, the recessed portion 255 may also be recessed downward from the top surface of the first door 21. Alternatively, the recessed portion 255 may also be recessed horizontally on one side surface of the first door 21.

A portion of the hinge device 80 may be inserted into the recessed portion 255 and connected to the bottom **255*a***.

A portion of the guide housing 34 extending in a straight-line shape when the first door 21 is in a closed state may be inserted into the recessed portion 255 and may be connected to the bottom **255*a* by a door fixing portion 90**.

In the present embodiment, since the water pipe 42 and the wire 44 are guided up to the recessed portion 255 of the first door 21 in a straight-line shape within the guide housing 34, the bending of the water pipe 42 and the wire 44 within the guide housing 34 may be minimized.

A door opening 255*b* may be formed in the bottom 255*a* of the recessed portion 255.

A hinge hole 255*c* through which the hinge pin passes may be formed in the bottom 255*a* of the recessed portion 255.

The rotation center C may pass through the hinge hole 255*c* in a vertical direction.

The water pipe 42 and the wire 44, which are guided to the recessed portion 255, may pass through the door opening 255*b* and may be then inserted into the first door 21. Alternatively, the water pipe 42 and the wire 44, which pass through the door opening 255*b* and are withdrawn from the inside of the first door 21, may be guided toward the cabinet 10 by the guide housing 34.

The door opening 255*b* is spaced apart from the hinge hole 255*c*. For example, the door opening 255*b* and the hinge hole 255*c* may be disposed in the left-and-right direction of the first door 21.

The diameter of the door opening 255*b* may be greater than the diameter of the hinge hole 255*c*.

With respect to the first side surface adjacent to the hinge hole 255*c* among two side surfaces of the first door 21, the distance between the first side surface and the hinge hole 255*c* may be greater than the distance between the first side surface and the door opening 255*b*.

The diameter of the door opening 255*b* may be greater than the distance from the front surface of the first door 21 to the door opening 255*b*.

Hereinafter, the structure of the first door is described in more detail.

Referring to FIGS. 3 and 4, the first door 21 of the present embodiment may include a door frame. The door frame may form a portion of the outer shape of the first door 21. The door frame may form at least a circumference of the first door 21.

The first door 21 may further include a door liner 270 coupled to the rear surface of the door frame.

The first door 21 may further include a front panel 240 coupled to the front surface of the door frame.

For example, the door frame may include all or some of an upper frame 250, a lower frame 268, and side frames 260 and 262 (see FIG. 5) connecting the upper frame 250 to the lower frame 268.

The door frame may be formed to have a rectangular frame shape including an opening by the upper frame 250, the lower frame 268, and the side frames 260 and 262 (see FIG. 5) connecting the upper frame 250 to the lower frame 268.

Figure 13:
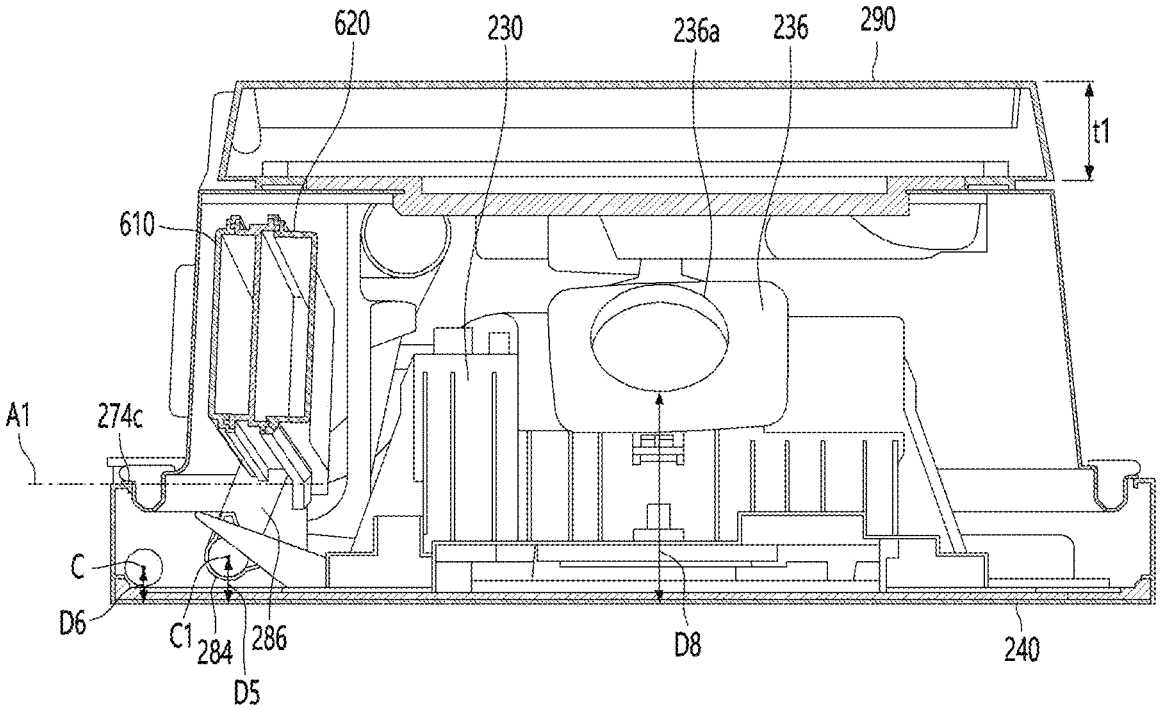
FIG. 13 is a cross-sectional view taken along line 13-13 of FIG. 1.

The door frame may further include a front frame (see 266 of FIG. 13). The front frame may cover the opening of the door frame in front of the door frame.

The front panel 240 may be located on the front surface of the front frame (see 266 of FIG. 12) in the door frame. The front panel 240 is not limited, but may be coupled to the upper frame 250 and the lower frame 268.

The front panel 240 may include a panel opening to expose the dispenser 23. The front frame may also include a frame opening corresponding to the panel opening.

The door liner 270 may form an ice-making compartment (described later) that accommodates an ice maker that generates ice. The ice-making compartment of the door liner 270 may be covered by an ice-making compartment door 290.

The door liner 270 may include a first liner 271 forming the ice-making compartment and a second liner 271*a* located below the first liner 271.

When the first door 21 is viewed from the side, the left-and-right width of the second liner 271*a* may be greater than the left-and-right width of the first liner 271.

The second liner 271*a* may form a space in which a filter that purifies water discharged from the dispenser 23 and/or a water tank that stores water purified in the filter are located.

The second liner 271*a* may include a first cold air opening 276 and a second cold air opening 277. Cold air to be supplied to the ice-making compartment may be introduced into the first cold air opening 276. The cold air supplied to the ice-making compartment may be discharged from the first door 21 through the second cold air opening 277.

The first cold air opening 276 may be located above the second cold air opening 277 and may be aligned in the vertical direction.

As described later, a cold air duct communicating with the ice-making compartment may be provided in the first door 21.

Figure 5:
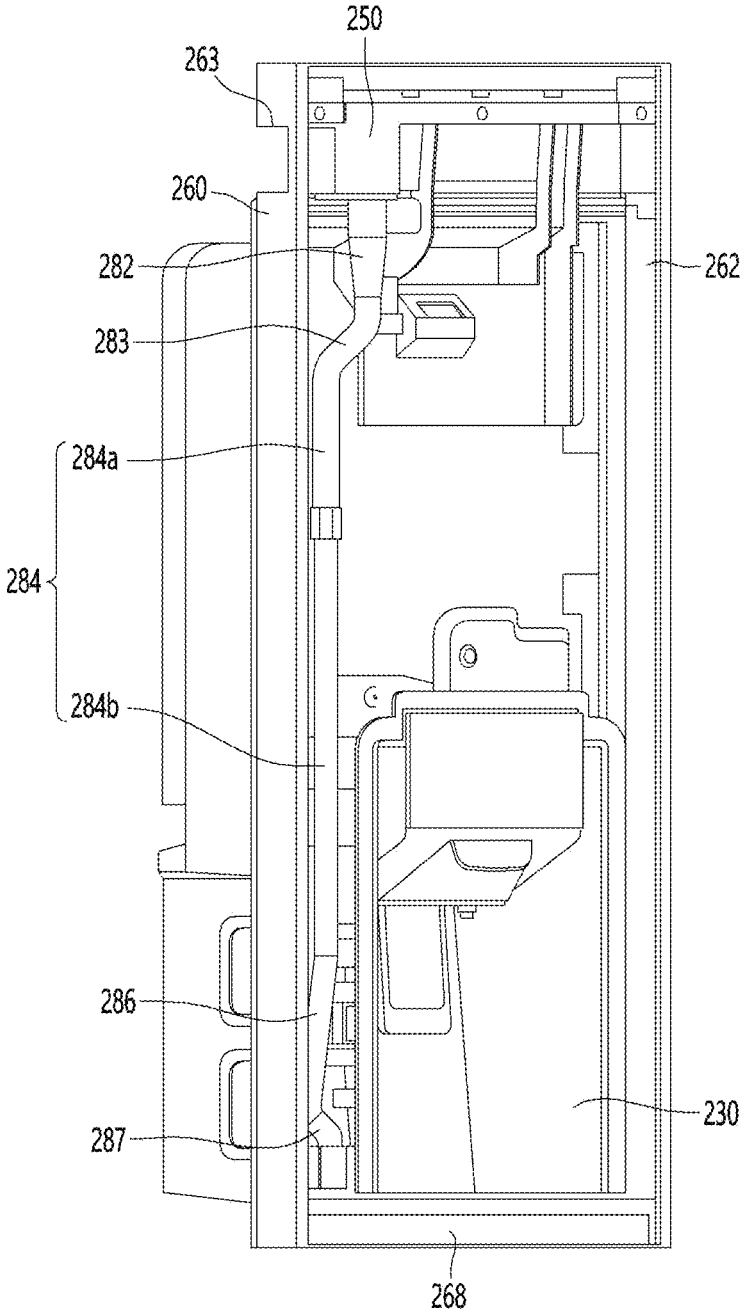
FIG. 5 is a perspective view showing the internal configuration of the first door of the present embodiment.
Figure 6:
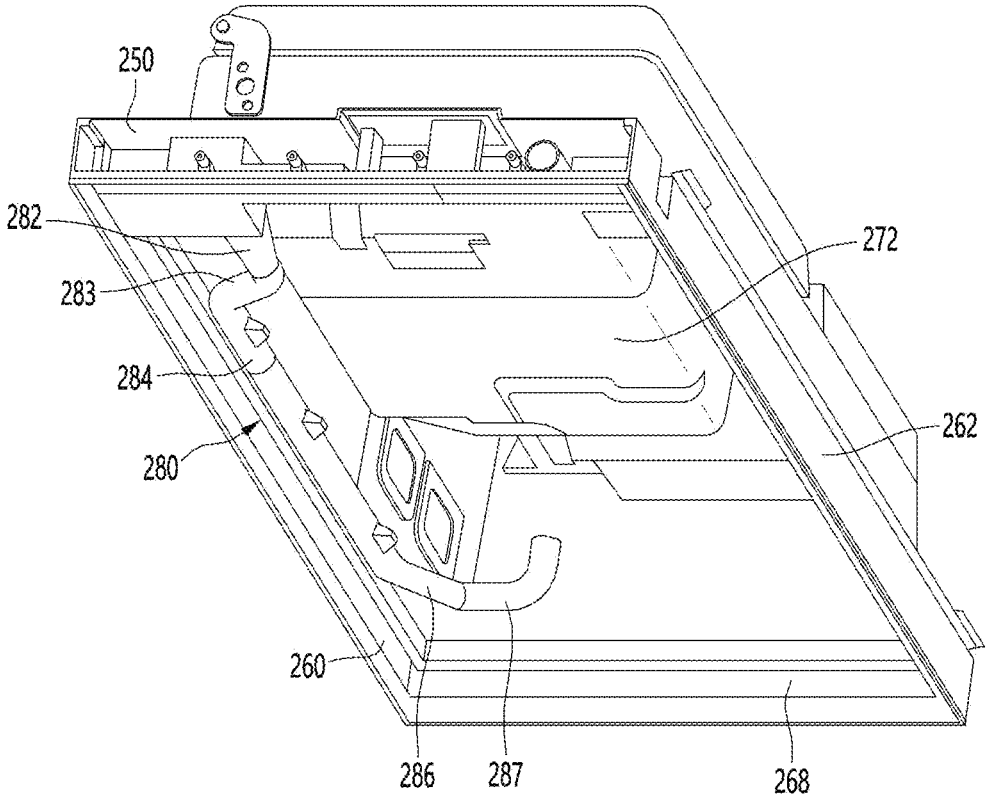
FIG. 6 is a perspective view showing the arrangement of a door guide inside the first door of the present embodiment.
Figure 7:
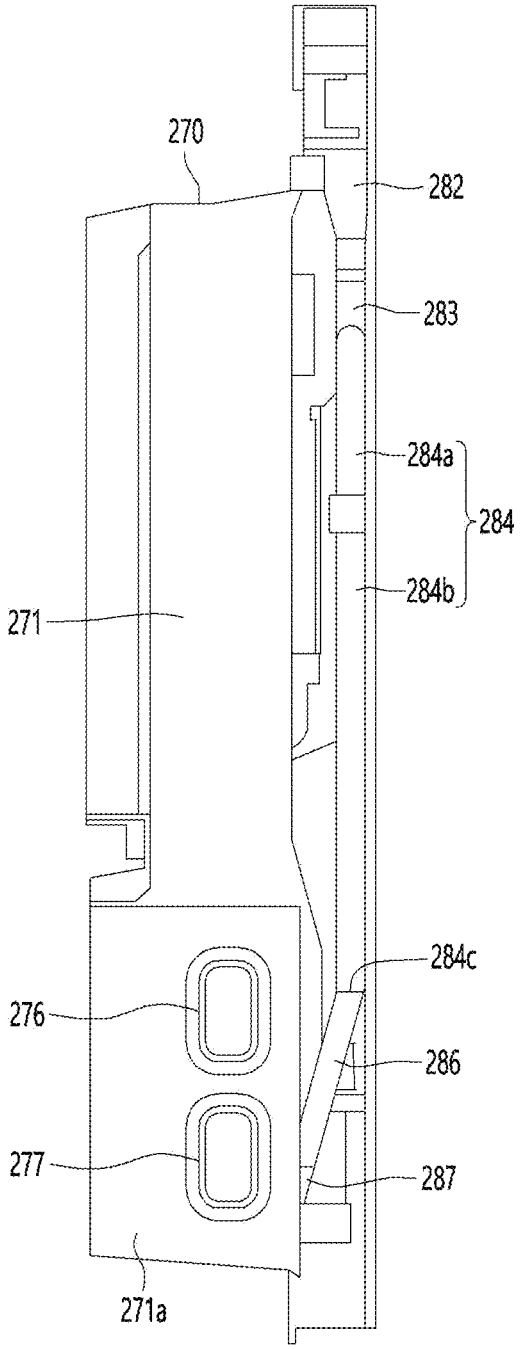
FIG. 7 is a partial cutaway view showing the arrangement of the door guide inside the first door of the present embodiment.
Figure 8:
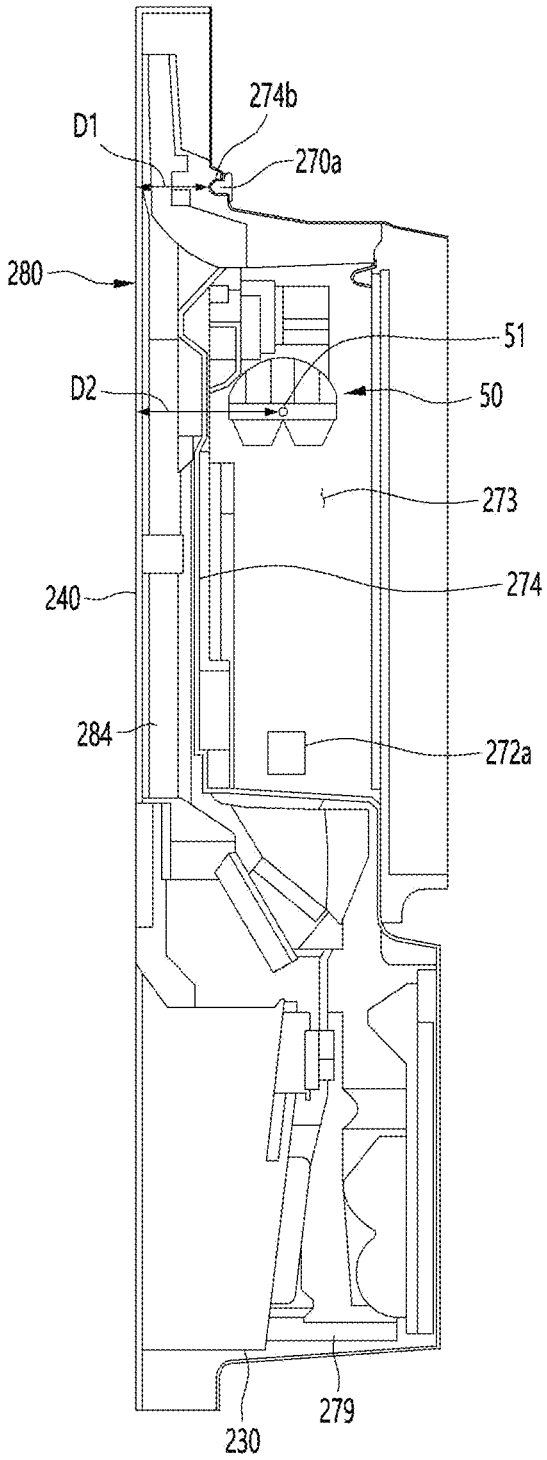
FIG. 8 is a view showing an arrangement relationship between an ice-making compartment wall, the door guide, and a dispenser in the first door of the present embodiment.

FIG. 5 is a perspective view showing the internal configuration of the first door of the present embodiment, FIG. 6 is a perspective view showing the arrangement of the door guide inside the first door of the present embodiment, FIG. 7 is a partial cutaway view showing the arrangement of the door guide inside the first door of the present embodiment, and FIG. 8 is a view showing an arrangement relationship between the ice-making compartment wall, the door guide, and the dispenser in the first door of the present embodiment.

Referring to FIGS. 3 to 8, the side frames 260 and 262 may include a first side frame 260 and a second side frame 262. The first side frame 260 may be in contact with one side surface of the upper frame 250 and one side surface of the lower frame 268.

The second side frame 262 may be in contact with the other side surface of the upper frame 250 and the other side surface of the lower frame 268. In the present embodiment, the thickness of the door frame may be reduced, and the side frames 260 and 262 may each be formed of a metal material so as to improve the strength of the reduced door thickness.

The first side frame 260 is located adjacent to the recessed portion 255. The first side frame 260 may include an opening 263 formed at a position corresponding to the recessed portion 255. The opening 263 allows the first door 21 to rotate without interference with the hinge device 80.

The first door 21 may further include a door guide 280 that guides the water pipe 42 within the first door 21.

The first door 21 may further include a dispenser housing 230. The dispenser housing 230 may be located between the first side frame 260 and the second side frame 262. The dispenser housing 230 may be spaced apart from the first side frame 260 and the second side frame 262.

The door guide 280 may extend from the door opening 255*b* to the dispenser housing 230. For example, the door guide 280 may extend from the upper frame 250 to the lower frame 268.

The door guide 280 may be formed in a tube shape having a passage therein and may be bent once or more times.

A foaming liquid for forming an insulation material may be injected into the first door 21. The water pipe 42 is accommodated in the door guide 280. Accordingly, the water pipe 42 may be prevented from contacting the foaming liquid, and the water pipe 42 may be prevented from being damaged in a foaming process.

The upper side of the door guide 280 may be fixed to the bottom 255*a* of the recessed portion 255 of the upper frame 250. The door guide 280 may be aligned with the door opening 255*b* in a state of being fixed to the bottom surface of the bottom 255*a*.

Accordingly, the water pipe 42 having passed through the door opening 255*b* may be inserted into the door guide 280.

The door guide 280 may include a first part 282 aligned with the door opening 255*b*. The first part 282 may extend in the vertical direction.

At least a portion of the door opening 255*b* may overlap the dispenser housing 230 in the vertical direction. When the door guide 280 extends downward in a straight-line shape, the door guide 280 may interfere with the dispenser housing 230.

Accordingly, the door guide 280 may further include a second part 283 that is inclined or bent from the first part 282.

The second part 283 may be extended to be inclined downward from the first part 282 toward the first side frame 260.

The door liner 270 may further include an ice-making compartment wall 272 that forms an ice-making compartment 273. The ice-making compartment 273 may be provided with an ice maker 50. Water supplied to the ice maker 50 may be phase-changed into ice by cold air supplied to the ice-making compartment 273.

Since the water pipe 42 is bent while passing through the door opening 255*b*, the first part 282 may extend in a straight-line shape in the vertical direction, such that more than a predetermined length of the water pipe 42 is maintained in a straight-line shape within the door.

At least a portion of the first part 282 may be disposed to overlap the ice-making compartment wall 272 in the front-and-back direction of the first door 21.

Since cold air for making ice exists in the ice-making compartment 273, the second part 283 may be inclined in a direction away from the ice-making compartment wall 272 so as to prevent the water pipe 42 in the door guide 280 from being frozen by the cold air.

The door guide 280 may further include a third part 284 extending downward from the second part 283. The third part 284 may extend downward in a substantially straight-line shape.

The third part 284 may extend into the space between the dispenser housing 230 and the first side frame 260.

The third part 284 may be a single pipe or may be formed by connecting a plurality of pipes. When the third part 284 includes a plurality of pipes, the third part 284 may include an upper pipe 284*a* and a lower pipe 284*b* coupled to the upper pipe 284*a*. The lower pipe 284*b* may be connected to the upper pipe 284*a*, and the lower pipe 284*b* may extend into the space between the dispenser housing 230 and the first side frame 260.

Due to the inclination of the second part 283, the third part 284 may be disposed not to overlap the ice-making compartment wall 272 in the front-and-back direction of the first door 21.

A wall facing the front panel 240 among the ice-making compartment walls 272 may be referred to as a front wall 274. At this time, the front-to-back horizontal distance between the front panel 240 and the front wall 274 may be greater than the front-to-back horizontal distance between the front panel 240 and the third part 284.

The door guide 280 may further include a fourth part 286 extending rearward from the third part 284. The door guide 280 may further include a fifth part 287 extending obliquely with the fourth part 286.

Alternatively, the entire portion extending from the third part 284 may be referred to as the fourth part 286 without distinction between the fourth part 286 and the fifth part 287. Alternatively, the fifth part 287 may be omitted.

A lower end 284*c* of the third part 284 may be located lower than an upper end of the first cold air opening 276.

When the number of bending or the amount of bending of the water pipe 42 is large, the water flow resistance in the water pipe 42 increases. In order for the water pipe 42 inside the door guide 280 to extend in a straight-line shape, the door guide 280 has to extend in a straight-line shape as much as possible. The water flow resistance in the water pipe 42 may also be minimized.

In terms of flow resistance, it is preferable that the third part 284 extends vertically in a straight-line shape, and the ratio of the length of the third part 284 to the total length of the door guide 280 may be the greatest.

The lower end 284*c* of the third part 284 may be located higher than an upper end of the second cold air opening 277.

The fourth part 286 may extend rearward from the third part 284 and extend away from the first side frame 260. The fourth part 286 may extend to be close to the dispenser housing 230.

The fifth part 287 may extend rearward from the fourth part 286. The fifth part 287 may be connected to a supporter 279 that is coupled to the door liner 270 in the fourth part 286. The supporter 279 may support one or more components inside the first door 21. The water pipe 42 may pass through the supporter 279 and may be then connected to the filter or valve.

In the present embodiment, since the wire 44 passes through the door opening 255*b*, the wire 44 may also be accommodated in the door guide 280.

That is, the door guide 280 may accommodate and guide the water pipe 42 and the wire 44 together.

Meanwhile, the ice maker 50 may be disposed to be rotatable within the ice-making compartment 273 by a rotation center 51.

In the present specification, when the first door 21 is closed, the door liner 270 may be inserted into the storage space of the cabinet 10. Accordingly, when the first door 21 is in a closed state, the thickness of the first door 21 may be said to be substantially the thickness of the door frame.

A gasket 270*a* may be coupled to the door liner 270 so as to prevent leakage of cold air by contacting the cabinet 10. The door liner 270 may include a gasket coupling portion 274*b* to which the gasket 270*a* is coupled.

A horizontal distance D2 between the front surface (or the front panel 240) of the first door 21 and the rotation center 51 of the ice maker 50 may be greater than a horizontal distance D1 between the front surface (or the front panel 240) of the first door 21 and the gasket 270*a* (or the gasket coupling portion).

A vertical line passing through the rotation center 51 of the ice maker 50 may be located at the rear side spaced apart from the gasket 270*a*.

Figure 9:
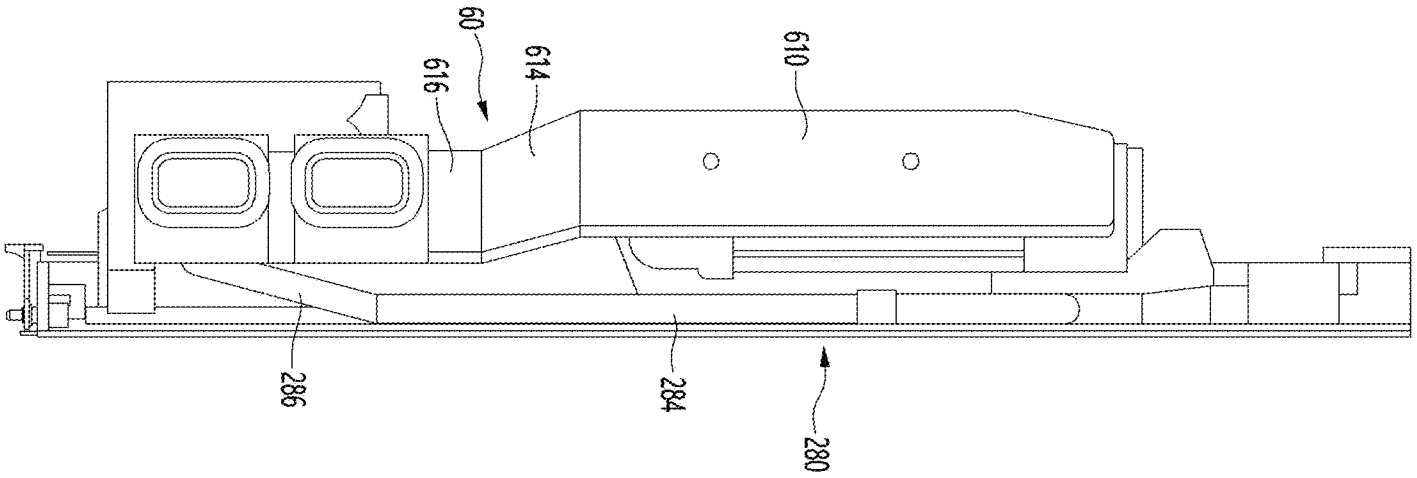
FIG. 9 is a view showing the arrangement of the door guide and a cold air duct of the present embodiment.
Figure 10:
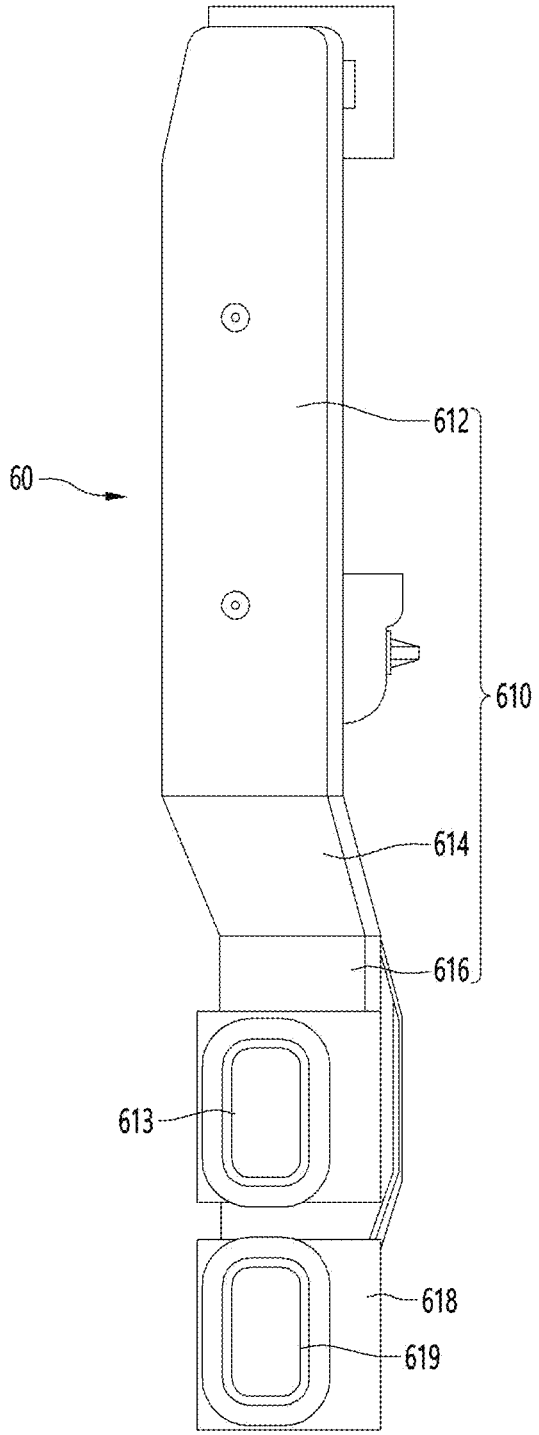
FIG. 10 is a view of the cold air duct of the present embodiment when viewed from the first duct side.
Figure 11:
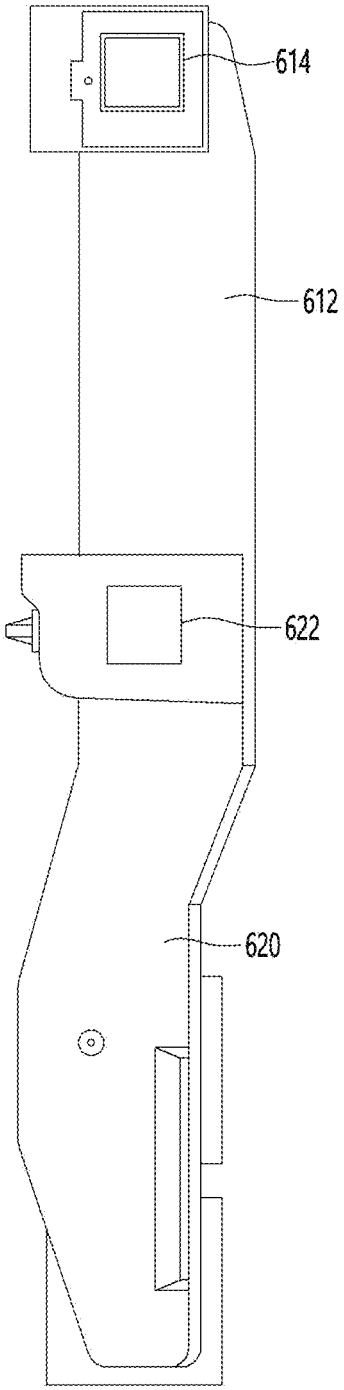
FIG. 11 is a view of the cold air duct of the present embodiment when viewed from the second duct side.

FIG. 9 is a view showing the arrangement of the door guide and the cold air duct of the present embodiment, FIG. 10 is a view of the cold air duct of the present embodiment when viewed from the first duct side, and FIG. 11 is a view of the cold air duct of the present embodiment when viewed from the second duct side.

Figure 12:
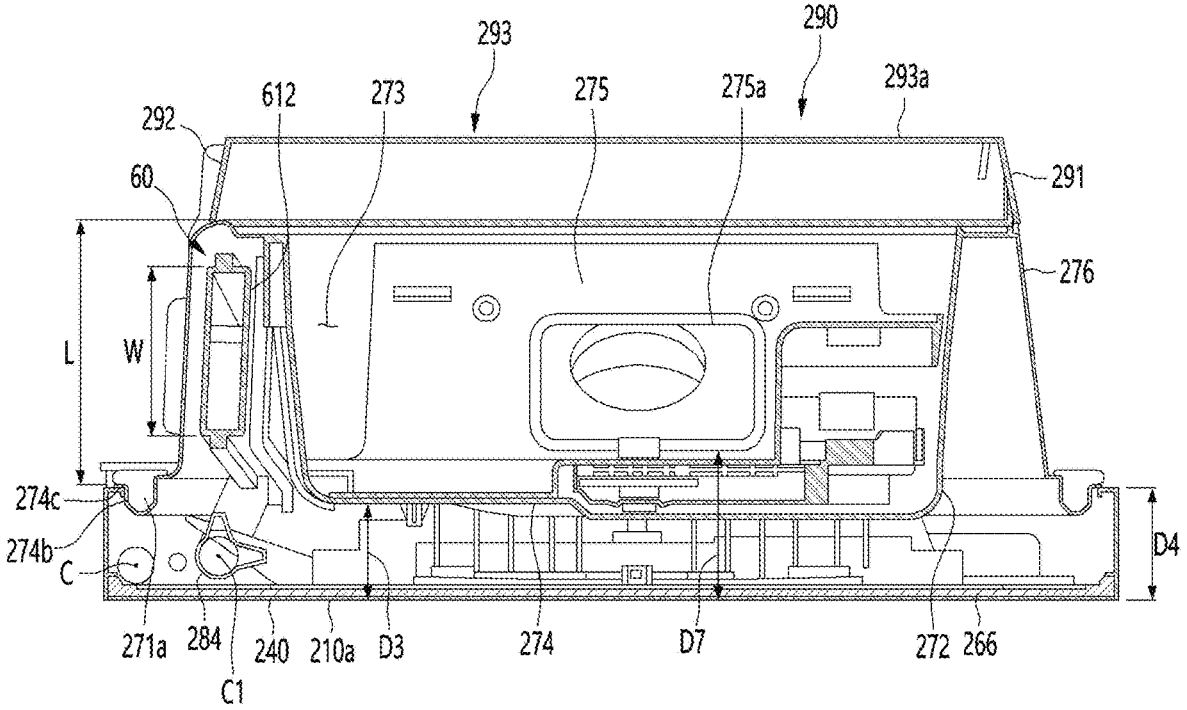
FIG. 12 is a cross-sectional view taken along line 12-12 of FIG. 1.

FIG. 12 is a cross-sectional view taken along line 12-12 of FIG. 1, and FIG. 13 is a cross-sectional view taken along line 13-13 of FIG. 1.

Referring to FIGS. 9 to 13, the first door 21 of the present embodiment may further include a cold air duct 60.

The cold air duct 60 may include a first duct 610 that communicates the first cold air opening 276 with the ice-making compartment 273. The first duct 610 may guide cold air to the ice-making compartment 273.

The first duct 610 may include a first cold air hole 613 communicating with the first cold air opening 276. The first duct 610 may further include a second cold air hole 614 communicating with the ice-making compartment 273.

The second cold air hole 614 may be located higher than the first cold air hole 613.

The cold air introduced into the first duct 610 through the first cold air hole 613 may be moved upward along the first duct 610 and then supplied to the ice-making compartment 273 through the second cold air hole 614.

Although not shown, a first ice-making compartment hole aligned with the second cold air hole 614 may be formed in the ice-making compartment wall 272.

The first duct 610 may include a first portion 612. The first duct 610 may further include a second portion 614 extending obliquely from the lower side of the first portion 612.

The first duct 610 may further include a third portion 616 extending downward from the second portion 614.

The first portion 612 may include the second cold air hole 614. The third portion 616 may include the first cold air hole 613.

The vertical length of the first portion 612 may be longer than the vertical length of each of the second portion 614 and the third portion 616.

The vertical length of the first portion 612 may be longer than the sum of the vertical lengths of the second portion 614 and the third portion 616.

The first portion 612 may be disposed adjacent to one of two side surfaces of the first liner 271. The first portion 612 may be disposed to face the one side surface of the first liner 271.

The second portion 614 may extend in a direction away from the one side surface of the first liner 271. The second portion 614 may be inclined in a direction close to the front surface of the first door 21.

The first duct 610 may further include a discharge portion 618 located below the third portion 616.

The internal passage of the discharge portion 618 may be divided into the internal passage of the third portion 616. The discharge portion 618 may be integrally formed with the third portion 616 or may be coupled to the third portion 616. The third portion 616 may include a fourth cold air hole 619.

The cold air duct 60 may further include a second duct 620 that communicates the second cold air opening 277 with the ice-making compartment 273. The second duct 620 may guide cold air from the ice-making compartment 273 to the second cold air opening 277. Although not shown, the cabinet 10 may include a first cabinet opening and a second cabinet opening that are aligned with the first cold air opening 276 and the second cold air opening 277 when the first door 21 is in a closed state.

At least a portion of the second duct 620 may be disposed to overlap the first duct 610.

For example, the first duct 610 and the second duct 620 may be disposed to overlap each other in the left-and-right direction of the first door 21.

The second duct 620 may be located between the first duct 610 and the dispenser housing 230.

The second duct 620 may include a third cold air hole 622. The third cold air hole 622 may be aligned with the second ice-making compartment hole **272*a* of the ice-making compartment wall 272**.

The first ice-making compartment hole and the second ice-making compartment hole **272*a*** may be disposed in the vertical direction.

The lower side of the second duct 620 may communicate with the discharge portion 618.

The cold air in the ice-making compartment 273 may pass through the second ice-making compartment hole **272*a* and may be then introduced into the second duct 620 through the third cold air hole 622. The cold air that is introduced into the second duct 620 moves downward along the second duct 620 and then flows to the discharge portion 618. The cold air that is introduced into the discharge portion 618 may be discharged from the first door 21 through the fourth cold air hole 619**.

Meanwhile, at least a portion of the door guide 280 may be disposed to overlap the cold air duct 60 in the front-and-back direction of the first door 21.

For example, the third part 284 may be disposed to overlap the first duct 610 in the front-and-back direction of the first door 21.

The second portion 614 may be inclined to be closer to the third part 284 at the lower side of the first portion 612.

Therefore, the horizontal distance between the first portion 612 and the third part 284 may be greater than the horizontal distance between the second portion 614 and the third part 284 and the horizontal distance between the third portion 616 and the third part 284.

That is, the distance between the first portion 612 and the third part 284, which is the longest length in the first duct 610, is maximum. As described above, when the distance between the first portion 612 and the third part 284 is maximum, it is possible to minimize the freezing of the water in the water pipe 42 within the door guide 280 by the cold air flowing through the cold air duct 60.

The horizontal distance between the upper side of the second portion 614 and the third part 284 is greater than the horizontal distance between the third portion 616 and the third part 284.

As the second portion 614 is inclined to be closer to the third part 284 at the lower side of the first portion 612, the second portion 614 extends in a direction away from the one side surface of the first liner 271. Accordingly, as the distance to the lower side decreases, the decrease in distance between the second portion 614 and the third part 284 may be minimized.

Since the second portion 614 extends in a direction away from the one side surface of the first liner 271, the third part 284 may not overlap the third portion 616 in the front-and-back direction of the first door 21.

Meanwhile, referring to FIGS. 12 and 13, the door liner 270 may further include a protruding dike 276 accommodated in the storage space of the cabinet 10 so as to prevent cold air leakage when the first door 21 is in a closed state.

A portion of the dike 276 may form the ice-making compartment 273, and an insulating material may be located therein. Alternatively, it may be explained that a portion of the ice-making compartment wall 272 forms the dike 276.

The door liner 270 may further include a gasket coupling portion **274*b* as described above. The gasket coupling portion 274*b* may include an extension portion 274*c* that is in contact with the door frame. For example, the extension portion 274*c*** may extend in a straight-line shape.

The protruding length L of the dike 276 from the extension portion 274*c* or the door frame may be greater than at least one of the passage width W of the first duct 610 or the passage width of the second duct 620.

The passage width refers to the length of the passage of the first duct 610 and the second duct 620 in the front-and-back direction of the first door 21.

The protruding length of the dike 276 may be greater than the thickness of the door frame. At least one of the passage width W of the first duct 610 or the passage width of the second duct 620 may be greater than the thickness of the door frame.

The horizontal distance D3 (or the minimum horizontal distance) from the front surface 210*a* of the first door 21 to the front wall 274 may be shorter than the distance D4 from the front surface 210*a* of the first door 21 to the gasket 270*a* or the extension portion 274*c*.

The horizontal distance D3 from the front surface 210*a* of the first door 21 to the front wall 274 may be greater than ½ of the distance D4 from the front surface 210*a* of the first door 21 to the gasket 270*a* or the extension portion 274*c*.

Alternatively, the horizontal distance D3 from the front surface 210*a* of the first door 21 to the front wall 274 may be greater than ½ of the thickness of the door frame. In this case, since the thickness of the insulation material within the door frame is secured, there is an advantage that insulation performance may be maintained even though the thickness of the door is reduced.

The distance D5 from the front surface 210*a* of the first door 21 to the center C1 of the third part 284 is greater than the distance D6 from the front surface 210*a* of the first door 21 to the rotation center C of the first door 21.

The distance from the front surface 210*a* of the first door 21 to the center of the door opening 255*b* is greater than the distance D6 from the front surface 210*a* of the first door 21 to the rotation center C of the first door 21.

The distance from the front surface 210*a* of the first door 21 to the center of the door opening 255*b* may be substantially equal to the distance D5 from the front surface 210*a* of the first door 21 to the center C1 of the third part 284.

The horizontal distance D3 from the front surface 210*a* of the first door 21 to the front wall 274 may be greater than the distance D5 from the front surface 210*a* of the first door 21 to the center of the third part 284.

In the first duct 610, at least the entire first portion 612 may be located inside the dike 276.

The entire area of the first portion 612 may be located behind an imaginary line A1 (between the imaginary line A1 and the ice-making compartment door 290) with respect to the imaginary line A1 extending from the extension portion 274*c*. That is, the horizontal distance from the front surface 210*a* of the first door 21 to the first portion 612 may be greater than the horizontal distance from the front surface 210*a* of the first door 21 to the extension portion 274*c* or the imaginary line A1.

An ice discharge hole 275*a* may be formed in the bottom 275 of the ice-making compartment wall 272. An ice chute 236 may be provided below the bottom 275 to guide ice having passed through the ice discharge hole 275*a* to the dispenser 23. The ice chute 236 may include an ice opening 236*a* for ice discharge.

The horizontal distance D7 from the front surface 210*a* of the first door 21 to the ice discharge hole 275*a* may be greater than the horizontal distance D4 from the front surface 210*a* of the first door 21 to the gasket 270*a* or the extension portion 274*c*.

The horizontal distance D8 from the front surface 210*a* of the first door 21 to the ice opening 236*a* may be greater than the horizontal distance D4 from the front surface 210*a* of the first door 21 to the gasket 270*a* or the extension portion 274*c*.

The ice-making compartment door 290 may include two side surfaces 291 and 292 and a connection surface 293 connecting the two side surfaces. The connection surface 293 may include a straight portion 293*a* connecting the two side surfaces 291 and 292 in a straight line.

When the distance from the entrance of the ice-making compartment 273 to the straight portion 293*a* increases due to the straight portion 293*a*, the thickness t1 of the ice-making compartment door 290 may increase. An insulating material for heat insulation is also provided inside the ice-making compartment door 290. When the thickness t1 of the ice-making compartment door 290 increases, the thickness of the insulating material may increase, thereby improving insulation performance.

The invention claimed is:

1. A refrigerator comprising:

a cabinet comprising a storage space;

a door configured to open or close the storage space, the door comprising a dispenser; and a hinge device configured to rotatably connect the door to the cabinet, wherein the door comprises:

a door frame including a door opening disposed at a position spaced apart from a rotation center by the hinge device;

a door liner coupled to the door frame and having an ice-making compartment wall forming an ice-making compartment, the ice-making compartment wall including a front wall; and an ice maker accommodated in the ice-making compartment to generate ice, wherein at least one of a water pipe or a wire is withdrawn from an inside to an outside of the cabinet and is inserted into the first door through the door opening, wherein a horizontal distance from a front surface of the door to a center of the door opening is greater than a distance from the front surface of the door to the rotation center, and wherein the horizontal distance from the front surface of the door to the center of the door opening is less than a distance from the front surface of the door to the front wall facing the front surface of the door.

2. The refrigerator of claim 1, wherein the door further comprises a gasket coupling portion to which a gasket in contact with the cabinet is coupled, wherein the gasket coupling portion comprises an extension portion that is in contact with the door frame, and wherein a horizontal distance from the front surface of the door to the front wall is greater than ½ of a distance from the front surface of the door to the extension portion.

3. The refrigerator of claim 1, wherein a horizontal distance from the front surface of the door to the front wall is greater than ½ of a thickness of the door frame.

4. The refrigerator of claim 1, wherein the door further comprises a gasket coupling portion to which a gasket in contact with the cabinet is coupled, and wherein a horizontal distance between the front surface of the door and a rotation center of the ice maker is greater than a horizontal distance between the front surface of the door and the gasket or a distance between the front surface of the door and the gasket coupling portion.

5. The refrigerator of claim 4, wherein a vertical line passing through a rotation center of the ice maker is located at a rear side spaced apart from the gasket.

6. The refrigerator of claim 1, wherein the door further comprises a gasket coupling portion to which a gasket in contact with the cabinet is coupled, wherein the gasket coupling portion comprises an extension portion that is in contact with the door frame, wherein an ice discharge hole is formed at a bottom of the ice-making compartment wall, and wherein a horizontal distance from the front surface of the door to the ice discharge hole is greater than a horizontal distance from the front surface of the door to the extension portion.

7. The refrigerator of claim 6, wherein an ice chute configured to guide ice having passed through the ice discharge hole to the dispenser is provided below the bottom of the ice-making compartment wall, wherein the ice chute comprises an ice opening for ice discharge, and wherein a horizontal distance from the front surface of the door to the ice opening is greater than a horizontal distance from the front surface of the door to the extension portion.

8. The refrigerator of claim 1, wherein the door further comprises:

a first duct configured to guide cold air to the ice-making compartment, and a second duct configured to guide the cold air discharged from the ice-making compartment to the outside of the door, wherein the door liner comprises a dike, a portion of which forms the ice-making compartment, the dike being disposed in a form that protrudes from the door frame, and wherein a protruding length of the dike is greater than a passage width of at least one of the first duct or the second duct.

9. The refrigerator of claim 8, wherein the protruding length of the dike is greater than a thickness of the door frame.

10. The refrigerator of claim 8, wherein the passage width of at least one of the first duct or the second duct is greater than a thickness of the door frame.

11. The refrigerator of claim 8, wherein the first duct comprises:

a first portion communicating with the ice-making compartment;

a second portion extending obliquely in a direction closer to the front surface of the door at a lower side of the first portion; and a third portion extending downward from the second portion.

12. The refrigerator of claim 11, wherein an entire area of the first portion is located inside the dike.

13. The refrigerator of claim 11, wherein the door further comprises a gasket coupling portion to which a gasket in contact with the cabinet is coupled, wherein the gasket coupling portion comprises an extension portion that is in contact with the door frame, and wherein a horizontal distance from the front surface of the door to the first portion is greater than a horizontal distance from the front surface of the door to the extension portion.

14. The refrigerator of claim 1, wherein the door further comprises a guide aligned with the door opening at an inside of the door to accommodate at least one of the water pipe or the wire therein.

15. The refrigerator of claim 14, wherein the guide comprises:

a first part aligned with the door opening;

a second part extending to be inclined toward one side frame of the door frame; and a third part extending into a space between the one side frame and the dispenser at the second part, and wherein a horizontal distance from the front surface of the door to the front wall is greater than a distance from the front surface of the door to a center of the third part.

16. The refrigerator of claim 1, further comprising an ice-making compartment door configured to open or close the ice-making compartment, wherein the ice-making compartment door comprises two side surfaces and a connection surface connecting the two side surfaces, and wherein the connection surface comprises a straight portion connecting the two side surfaces in a straight line.

* * * * *